United States Patent [19]

Santens et al.

[11] 4,300,251

[45] Nov. 17, 1981

[54] METHOD FOR BLEACHING AND DYEING SPOOLED THREADS

[75] Inventors: Lieven J. M. E. Santens, Oudenaarde; Robert M. Vander Beke, Heule, both of Belgium

[73] Assignees: Centre Scientifique et Technique de l'Industrie Textile Belge, en abrégé: "Centexbel", Brussels; "Santéns", Societe de Personnes à responsabilité Limitée, Oudenaarde, both of Belgium

[21] Appl. No.: 138,664

[22] Filed: Apr. 9, 1980

[30] Foreign Application Priority Data

Apr. 19, 1979 [BE] Belgium ..... 57740

[51] Int. Cl.[3] ..... D06B 5/18

[52] U.S. Cl. ..... 8/149.1; 8/149.3; 8/155; 68/5 C; 68/189

[58] Field of Search ..... 8/149.1, 149.3, 154, 8/155, 155.1, 155.2; 68/5 C, 7, 15, 189

[56] References Cited

U.S. PATENT DOCUMENTS

| | | | |
|---|---|---|---|
| 480,102 | 8/1892 | Keene | 8/157 X |
| 1,269,934 | 6/1918 | Holt et al. | 68/7 |
| 1,482,795 | 2/1924 | Jefferson | 8/149.1 X |
| 1,779,831 | 10/1930 | Stokes | 8/149.1 |
| 4,079,603 | 3/1978 | Bergholtz | 68/15 |

FOREIGN PATENT DOCUMENTS

| | | | |
|---|---|---|---|
| 14780 | of 1908 | United Kingdom | 68/189 |

*Primary Examiner*—Philip R. Coe

*Attorney, Agent, or Firm*—Stevens, Davis, Miller & Mosher

[57] ABSTRACT

The method comprises the steps of impregnating spooled threads with a cold treatment liquid inside a kier, leaving an air cushion above the liquid inside the kier, discharging the liquid from the kier through a liquid discharge outlet by feeding steam above the air cushion, stopping the discharge when the steam reaches the liquid discharge outlet, and treating the spooled threads with steam inside the kier.

2 Claims, 3 Drawing Figures

1
23
67
69
7
10
63
68

1
2
3
5
6
7
8
9
10
11
13
14
15
16
17
18
19
20
23
24
24'
25
26
27
28
29
30
31
32
33
34
35
36
37
38
63
70
71

METHOD FOR BLEACHING AND DYEING SPOOLED THREADS

BACKGROUND

The invention relates to a method for treating threads on spools which can be worked with the above-defined installation, and which comprises impregnating in cool condition the spooled thread with a treatment liquid inside a kier, discharging said liquid from the kier, and treating the spooled threads with steam inside said kier.

THE INVENTION

According to the invention, the impregnating is performed by leaving an air cushion above the liquid inside said kier, and the liquid is discharged from the kier by feeding steam above said air cushion, said discharge being stopped as the steam reaches the liquide discharge outlet.

In an advantageous embodiment of the invention, the steam treatment is regulated for a pre-determined time interval from that moment where a determined temperature is reached inside a spooled thread.

Other details and features of the invention will stand out from the following description of a method for bleaching and dyeing spooled threads, according to the invention, given hereinafter by way of non limitative example and with reference to the accompanying drawings, in which:

THE DRAWINGS

In the various figures, the same reference numerals pertain to similar elements.

DESCRIPTION OF THE PREFERRED EMBODIMENT

Figure 1:
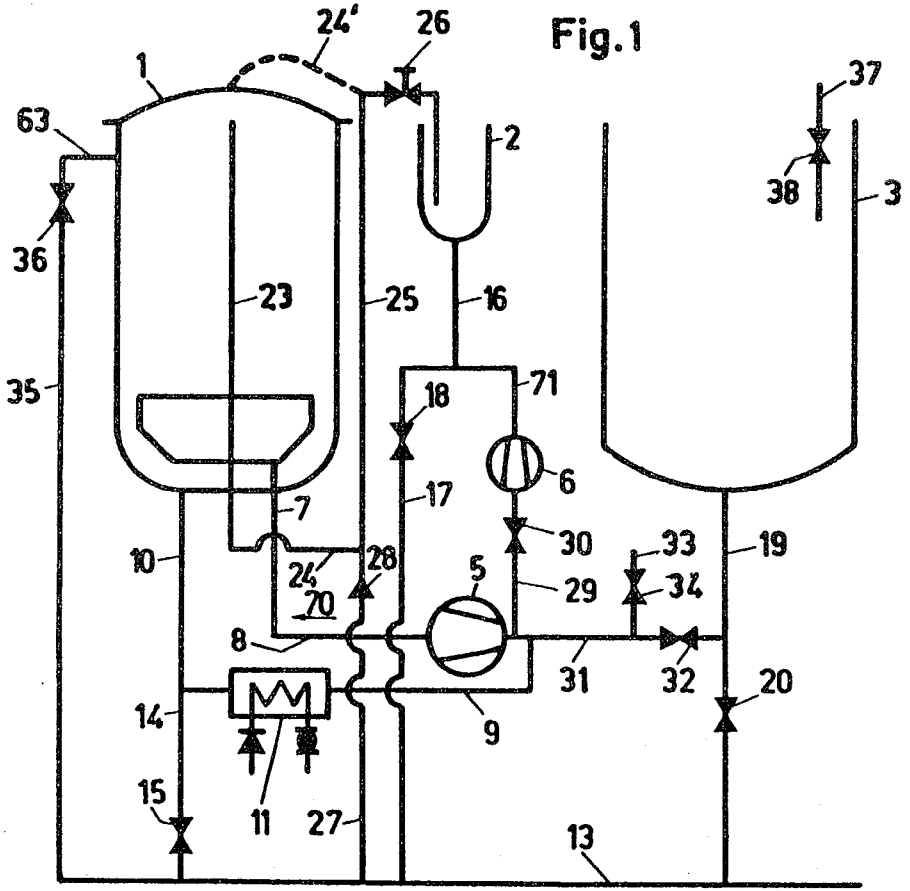
FIG. 1 is a diagrammatic showing of a known installation for bleaching and dyeing spooled threads.

The known installation as shown in FIG. 1 comprises a kier 1, an expansion tank 2 which is also used to add liquid, a tank 3 used for preparing the bleaching solution, pumps 5 and 6, a heat exchanger 11 and various pipes and valves which will be further described hereinafter.

Figure 2:
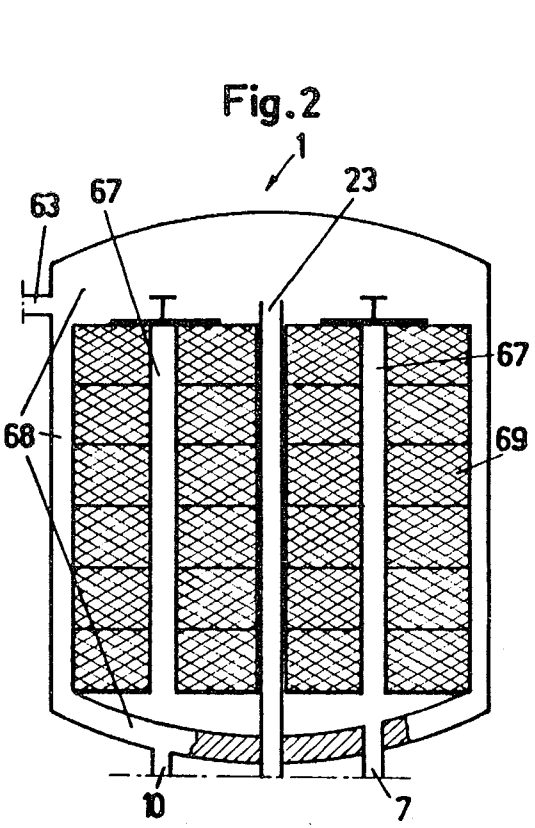
FIG. 2 is a somewhat less diagrammatic showing of the kier in the installation as shown in FIG. 1.

The kier 1 shown less diagrammatically in FIG. 2, is fitted with a material-holder for spooled threads 69. Said spooled threads bound inside said kier a first space 67 on the inner side of said spooled threads 69 and a second space 68 on the outer side therefrom.

The first inner space 67 is essentially comprised of the center channels of the stacked spooled threads. The second outer outer space 68 is comprised of the complete volume surrounding said spooled threads 69. As may be seen in FIG. 2, there is nowhere a direct communication between said inner space 67 and outer space 68. Liquid can flow from inner space 67 to outer space 68 or vice versa but through the spooled threads 69.

A closed circuit is formed by said inner space 67, pipes 7 and 8, pump 5, pipes 9 and 10, inner space 68 and spooled threads 69.

Said pump 5 forces the liquid in the direction shown by arrow 70, thus in such a direction that through said spooled threads 69 the liquid flows from the inner space 67 towards the outer space 68.

The heat exchanger 11 is cut-in into pipe 9.

Said kier 1 is connected to the main discharge pipe 13 through said pipe 10 and by the discharge pipe 14 which comprises valve 15.

The suction side of pump 15 is connected not only to pipe 9 but also to pipe 29 which comprises the valve 30 and which is fed by pump 6 from expansion tank 2 through pipes 16 and 71.

A pipe 23 communicates with the top portion from outer space 68 of kier 1 and passes through said kier bottom without communicating with inner space 67. Said pipe 23 is connected by pipe 24 to pipe 25 which comprises valve 26 and opens in expansion tank 2.

The liquid from the top portion of outer space 68 can thus overflow through pipes 23, 24 and 25, when valve 26 is open, into expansion tank 2 from which the liquid is sucked by pump 6 and forced through pipe 29 when valve 30 is open, into that circuit formed by pump 5, pipes 8 and 7, kier 1 and pipes 10 and 9.

Said pipe 16 is also connected to the main discharge pipe 13 by pipe 17 which comprises valve 18.

Pipe 25 is also connected by pipe 27 comprising a safety valve 28, to the main discharge pipe 13. Said kier 1 can thus also overflow into said main discharge pipe 13 through pipes 23, 24 and 27.

The top portion of outer space 68 is further connected to the main discharge pipe 13 through connection 63 and a pipe 35 which comprises valve 36.

The preparation tank 3 is fed with water by pipe 37 which comprises valve 38. Said tank 3 is connected to the main discharge pipe 13 by pipe 19 comprising valve 20. Pipe 31 connects pipe 19 on the one hand to pipes 9 and 29 on the other hand. Said pipe 31 comprises a valve 32 and on the side of pipes 9 and 29 relative to said valve, a feed pipe 33 which comprises a valve 34.

The installation as shown in FIG. 1 and the kier as shown in FIG. 2 which have been described above are known. It is also known to connect pipe 7 to a steam source to feed steam into the inner space 67 and to connect pipe 10 to a steam source to feed steam into outer space 68.

The installation for performing the method according to the invention and shown diagrammatically in FIG. 3 has a plurality of additional components which will be described hereinafter.

A vacuum pump is connected by a pipe 39 comprising a valve 40, to the connector 63 provided in the top portion of kier 1. The same connector 63 is connected by a pipe 41 comprising a valve 42, to a pressurized air source.

The kier is further provided with a level regulator 48.

A steam feed source feeds pipe 43 which is connected by pipe 44, comprising valve 45, to pipe 23 opening inside the top portion of outer space 68 in kier 1.

Figure 3:
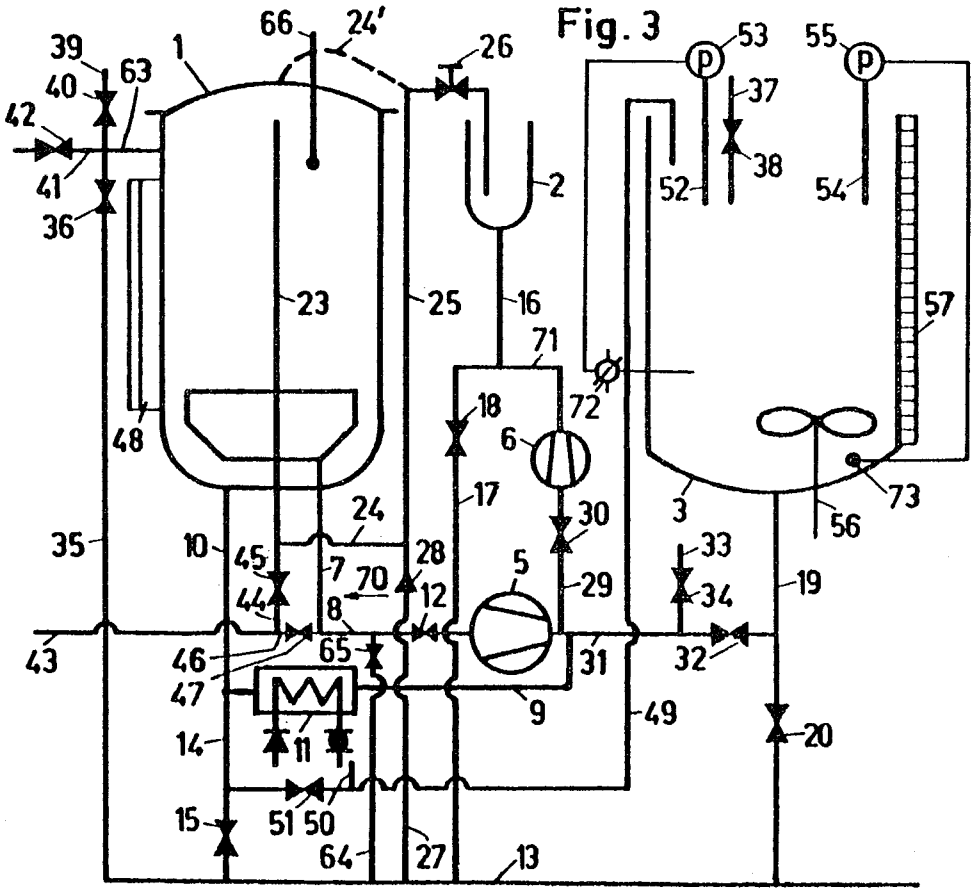
FIG. 3 is a diagrammatic showing of an installation used for performing the method for bleaching and dyeing spooled threads according to the invention.

It is to be noted that as opposed to the structure in the known installation described above, the steam is fed to the top portion of outer space 68 in the installation shown in FIG. 3.

The pipe 46 comprising valve 47, connects pipe 43 fed by the steam source to pipe 7 opening inside inner space 67 from kier 1.

The pipe 14 is connected between valve 15 and pipe 10 to a pipe 49 which opens inside the top portion of tank 3 used for preparing the bleaching solution.

The pipe 49 opens inside tank 3 in a point which lies above the maximum level of the liquid inside said tank.

The pipe 49 comprises a temperature-measuring device 50. Said device 50 controls a valve 51 which is cut-in into pipe 49, to close said valve when the measured temperature rises above a pre-determined value. The temperature-measuring device 50 is arranged between valve 51 and preparation tank 3. Said valve 51 is thus closed but when said pre-determined temperature has already been reached upstream of said valve in the direction of tank 3.

Another temperature-measuring device 66 measures the temperature inside a spooled thread 69 and controls the starting of a timer when a pre-determined temperature is reached, said timer closing valve 45 and/or valve 47 after a pre-determined time interval.

A valve 12 is cut-in into that pipe 8 which connects pipe 7 to pump 5. Said valve 12 is normally open; all the other valves are normally closed.

A pipe 64 comprising valve 65, connects pipe 8 between pipe 7 and valve 12, to the main discharge pipe 13.

Pipes 52 and 54 for feeding products which are part of the bleaching or dyeing solution, open in tank 3 and comprise metering pumps 53 and 55. Pipe 52 is used for instance to add a bleaching agent, for example hydrogen peroxide to the bath which is prepared and reconditioned inside tank 3; the flow rate of said agent can be adjusted by metering pump 53 under the control of an automatic titrating device 72. Pipe 54 is used for instance to add an alkali to adjust or re-adjust the suitable pH for the bath. Said alkali flow-rate is adjusted by metering pump 55 according to the pH-value as measured by the pH-meter 73.

Tank 3 is further provided with a stirrer 56 and a level regulator 57.

The installation as shown in FIG. 3 allows working some new methods requiring a shorter time interval for bleaching or dyeing, and/or which are less costly, and/or which give a product with a better quality.

A method which may be worked in the installation as shown in FIG. 3 is a bleaching method which also makes use of a steam treatment. Said method essentially comprises an impregnating step, a recuperating step combined with exhausting air from the kier, and a steam treatment step, possibly followed by soaping and other finishing operations.

Said various treatments will be described hereinafter.

a. Impregnating with the bleaching solution

In tank 3 is prepared a bleaching solution at room temperature, which lies normally between 18° and 25° C.

Said solution preferably comprises a wetting agent having a limited dispersing action and an anti-foam action. The temperature in the range from 18° to 25° C. of the bleaching solution which is also retained when said solution lies in kier 1, is preferred due to higher temperatures causing possibly a heat-decomposition of the solution. The wetting agent has preferably a limited dispersing action as the dispersion increases the danger of migrating; the agent has preferably an anti-foam action to prevent the building-up of foam during the steam treatment preventing a fast heating of the spools.

Use is made for example of 0.3 cc wetting agent per liter of the solution and said agent is for instance on the basis of etherified sulfate from phosphoric acid with anti-foam action.

Said bleaching solution is fed to the kier 1 from tank 3 by opening valve 32 and starting pump 5. When a sufficient amount of the solution has been fed in this way to kier 1, the valve 32 is closed. It is possible to work with different levels inside the kier, but it is required to retain an air cushion above the liquid.

In a first variation, the liquid level inside kier 1 is such that the spooled threads are completely immersed. To provide such variation, the valve 26 is opened, pump 6 is operating, valve 30 is open and pump 5 causes flowing through pipes 10, 9, 8 and 7 in the direction of arrow 70. The static pressure inside the kier is obtained by means of pump 6.

As pump 5 causes flowing in the direction of arrow 70, the bleaching solution passes through the spooled threads 69 from inner space 67 towards outer space 68.

In a second variation, said spooled threads 69 are partly immersed in the bleaching solution or are not immersed at all.

In this second variation, the level of the bleaching solution inside the kier is determined by the level regulator 48. To work according to this variation, the valve 42 is opened to bring the pressure inside kier 1 to about 2 bars. Pump 5 is started to cause a flow through pipes 10, 9, 8 and 7 in the direction of arrow 70 to let the solution pass through spooled threads 69 from inner space 67 towards outer space 68. The duration of the impregnation is dependent in both cases on the pump characteristics, but lies generally in a range from 5 to 10 minutes.

In both variations, the bleaching solution can be on the basis of hydrogen peroxide or sodium chlorite.

In both cases by using the above-mentioned wetting agent with said proportion, there is obtained a liquid absorption by the cotton thread in the range from 140 to 160%.

It is to be noted that the solution amount which is absorbed by the cotton is not determined by a pressurized-air squeezing or by a vacuum suction, thus by operations which follow the impegnation proper, but actually by means of a suitable proportion of a suitable wetting agent in the impregnating bath. This way of regulating the liquid absorption proportion in the cotton has the advantage relative to the pressurized-air squeezing, that the air discharge before the steam treatment is made.

b. Recovery of the bleaching solution in combination with exhausting air from the kier After the above-described impregnating, pump 5 is stopped and possibly pump 6 when same is still working, and valve 26 is closed when same is open. Valve 45 is opened and thus steam is fed to the top portion of outer space 68. It is to be noted that whatever the variation of impregnating being performed, there is always an air cushion above the liquid which is present inside the kier. The steam which is fed due to opening of valve 45 through pipe 23 into the top portion of kier 1, flows to the volume above said air cushion which forms a heat-isolating screen between the steam on the one hand and the bath on the other hand.

The valve 51 is opened. The bath is forced through pipes 10, 14 and 49 to tank 3. During such forcing-back operation, the air cushion acts as heat isolation and the bath is not markedly heated by the steam forcing same back. The temperature-measuring device 50 provided at the inlet to pipe 49 but beyond valve 51 in the direction of tank 3, controls said valve 51. Said device 50 is so adjusted that it closes the valve when the temperature it is subjected to rises above a determined value. Said value corresponds to the steam temperature. The discharge from the kier is thus stopped at the moment where the steam has reached the temperature-measuring device 50 and has thus flowed past valve 51.

The temperature-measuring device should be sensitive both to liquids and gases. The bleaching solution fed to tank 3 is conditioned back when required, by the addition of agents which are fed through pipes 52 and 54 by said metering pumps 53 and 55.

Indeed, the composition of said bleaching solution has changed during the treatment inside the kier. On the one hand, agents originally present in the solution have reacted with the spooled threads. On the other hand, elements from the thread and reaction products have entered the solution. Said solution has thus to be partly prepared again. It has been noticed in actual practice that it is possible to use for about ten times the same bleaching solution when after each treatment, bleaching agent and alkali are added to the solution when same has been forced back to tank 3. The bath composition and the forming-back thereof vary according to the thread to be treated. When the bleaching agent is hydrogen peroxide, the proportion thereof and the pH value as to be retained constant. The pH value can be ascertained with a pH-meter and the hydrogen peroxide proportion can be ascertained by titrating with potassium permanganate.

For Bresilian 20/2 cotton, the bath composition is for instance as follows:

25 cc/l 35% $H_2O_2$
0.9 cc/l NaOH, 36° Be
3 g/l organic stabilizer
0.3 cc/l wetting agent
pH: 11

After each treatment when the liquid used for said treatment has been forced back to the preparation tank 3, the pH value is restored by adding caustic soda and the hydrogen peroxide proportion is restored by adding a suitable amount of peroxide as determined by titrating with potassium permanganate.

c. Stream treatment

After closing valve 51, that is when the liquid has been completely transferred from kier 1 to tank 3, valve 47 is also opened, valve 45 remaining open. Steam is thus fed at the top of outer space 68 through pipe 23 and at the bottom of inner space 67 through pipe 7. It is to be noted that as opposed to what occurs with the known methods, steam is simultaneously and not alternately fed to inner space 67 and outer space 68. Said steam thus heats spooled threads 69 on both sides, that is both from the inside and the outside. The steam is used substantially only to heat the spooled threads and said heating being made both from the inside and the outside results in the heating being fast and also distributed as uniformly as possible through the spooled threads. A temperature gradient through the spooled threads is thus prevented. Such a temperature gradient would enhance migrating.

There occurs some condensing inside the spooled threads, which increases the amount of absorbed liquid from about 150% to about 170%.

The heating duration should be as short as possible to prevent migrating. Said duration can be for instance of about 5 minutes. The steam temperature is for example in the range from 120° to 130° C. Use may for example be made of steam with a pressure of 1.4 bars which corresponds to a temperature of 122° C. The steam treatment goes on after the heating step.

The duration of such treatment is dependent on the nature of the cotton and the composition of the bleaching bath used previously, but it is for example about 15 minutes. The optimum duration is to be determined beforehand for every cotton to be treated and for every particular composition of the bleaching solution.

To obtain identical results from every treatment, it is required that the duration of the steam treatment be constant, said duration being determined from that moment where the spooled threads have reached the maximum temperature thereof. To obtain such a constant duration, there is provided the temperature-measuring device 66 inside one spooled thread 69 and said device 66 controls according to the measured temperature, said valves 45, 47 and 15.

The control should be such that the temperature-measuring device 66 when the pre-determined maximum temperature is reached inside the spooled thread, will start a timer which after a specific duration, for instance 12 minutes, will close valves 45 and 47 and open valve 15.

Spooled threads 69 are thus treated with steam during a fixed time interval, for instance about 12 minutes, from that moment where the spooled threads have been heated enough for the treatment temperature to have reached the middle area of the spooled thread.

The closing of valves 45 and 47 and opening of valve 15 results in a depressurizing of the kier. When no overpressure is present any more inside kier 1, valve 15 is closed and the following steps of the treatment are performed.

As shown in dotted lines in FIGS. 1 and 3, the cover of kier 1 may be connected directly to pipe 25. In such a case pipes 23 and 24 may be dispensed with in the embodiment as shown in FIG. 1 and pipe 23 may be dispensed with in the embodiment as shown in FIG. 3.

In this case the overflow from kier 1 occurs through pipe 24', either to expansion tank 2 when valve 26 is open, or to the main discharge pipe 13 when valve 26 is closed. As regards the overflow from kier 1, pipe 24' thus fulfills the function of pipes 23 and 24 in the embodiments as shown in FIGS. 1 and 3.

The pipe 24' also allows in the embodiment from FIG. 3, feeding steam to the top portion of outer space 68 when valve 45 is open. Indeed the steam may than flow through pipes 43, 44, 24, 25 and 24' to the top portion of said outer space 68. This does not change the above-described functions of the known installation shown in FIG. 1 and of the installation according to the invention shown in FIG. 3.

It must be understood that the invention is in no way limited to the above-described embodiments and that many changes can be brought therein without departing from the scope of the invention as defined by the appended claims.

We claim:

1. A method for treating spooled threads comprising the steps of impregnating the spooled threads with a cold treatment liquid inside a kier, leaving an air cushion above the liquid inside said kier, discharging the liquid from the kier through a liquid discharge outlet by feeding steam above the air cushion, stopping the discharge when the steam reaches the liquid discharge outlet, and treating the spooled threads with steam inside the kier.

2. The method for treating spooled threads of claim 1, in which the steam treatment is regulated for a predetermined duration from the moment where a determined temperature is reached inside a spooled thread.

* * * * *